United States Patent [19]

Breton

[11] Patent Number: 5,037,365

[45] Date of Patent: Aug. 6, 1991

[54] FOLDER WITH BELT SPEED CONTROL

[75] Inventor: Richard E. Breton, Rochester, N.H.

[73] Assignee: Harris Graphics Corporation, Dover, N.H.

[21] Appl. No.: 453,587

[22] Filed: Dec. 20, 1989

[51] Int. Cl.[5] ..... B65H 37/06

[52] U.S. Cl. ..... 493/18; 271/202; 271/270; 493/29; 493/423; 493/438; 493/441; 493/447

[58] Field of Search ..... 493/8, 18, 23, 29, 32, 493/409, 423, 438, 441, 447, 461; 270/45, 47, 51; 271/270, 202; 198/415, 623

[56] References Cited

U.S. PATENT DOCUMENTS

| | | | |
|---|---|---|---|
| 3,312,326 | 8/1965 | Huppenthal | 198/623 |
| 3,980,290 | 9/1976 | Sjoman et al. | 493/441 |
| 4,516,759 | 5/1985 | Kobler | 271/202 |

*Primary Examiner*—Frederick R. Schmidt
*Assistant Examiner*—Jack Lavinder
*Attorney, Agent, or Firm*—Tarolli, Sundheim & Covell

[57] ABSTRACT

An improved folder includes a first series of belts which grips and moves sheet material along converging deflectors to fold the sheet material. As the space between the deflectors narrows, a second series of belts grips the sheet material and continues its movement between the deflectors. The first series of belts includes a first plurality of tapes disposed on a first side of a fold line and a second plurality of tapes disposed on a second side of the fold line. The second series of belts includes a pair of creaser belts which extend from between the tapes to an outlet portion of the folder. The speed of movement of the tapes and creaser belts is coordinated by using speed signal generators which are driven at the speed of movement of the tapes and creaser belts. A controller compares the speed signals and maintains a desired relationship between the speed of movement of the tapes and creaser belts. It is believed that the creaser belts will usually be driven at the same speed. However, the creaser belts may be driven at slightly different speeds in order to compensate for deformation imparted to the sheet material before it moved between the creaser belts.

27 Claims, 7 Drawing Sheets

FOLDER WITH BELT SPEED CONTROL

BACKGROUND OF THE INVENTION

The present invention relates to a new and improved sheet material handling apparatus in which the speed of movement of a plurality of belts is coordinated to prevent unintended deformation of the sheet material.

A sheet material folding apparatus is disclosed in a copending U.S. Pat. application filed by Richard E. Breton and David B. Staley and entitled "Folder Apparatus". This application discloses a folder apparatus which is operable at a relatively high speed to form a plurality of folds in sheet material. The folds are formed by a series of folder assemblies through which the sheet material continuously moves at a relatively high speed. The folded sheet material is stacked on edge by a stacker assembly.

One of the folder assemblies includes a tapered array of belts which move the sheet material to be folded into the folder assembly. As the sheet material is moved by the tapered array belts,, it is engaged by a pair of creaser belts. The creaser belts grip opposites sides of the sheet material and move the sheet material out of the folder assembly.

During operation of this folder assembly, the speed of movement of the sheet material by the tapered array of belts and by the creaser belts must be accurately coordinated so that the sheet material can be gripped by the creaser belts while it is being moved by the tapered array of belts. Once the sheet material has been gripped by the creaser belts, the speed of movement of the upper and lower creaser belts must be accurately coordinated in order to prevent unintended deformation of the sheet material. Thus, if one of the creaser belts is moving faster than the other creaser belt, one side of the sheet material will be pulled forwardly relative to the other side of the sheet material.

Difficulties are encountered in coordinating the speed of movement of the creaser belts. This is because, the effective pitch diameters of the pulleys or sheaves which support and drive the creaser belts varies during operation of the folder. Variations in the effective pitch diameters of the creaser belt pulleys are due to several different factors. Included among these factors are: (1) the V-shaped configuration of cooperating surfaces on the pulleys and the creaser belts and (2) variations in the cross-sectional size of the creaser belts along the length of the creaser belt.

The creaser belt pulleys are of the well known V-type. A slight change in the spacing between the side surfaces of a creaser belt which engages a pulley results in a larger change in the pitch diameter of the pulley. Thus, if the distance between the side surfaces of a creaser belt decreases slightly, the creaser belt will move a larger distance inwardly toward the center of rotation of the pulley which it engages. Similarly, if the distance between the side surfaces of the creaser belt increases, the creaser belt will move a larger distance outwardly away from the center of rotation of the pulley. Therefore, the cooperation between the creaser belts and pulleys effectively magnifies any change in the cross section of the creaser belts.

The creaser belts may be commercially fabricated by an extrusion process. During extrusion of a creaser belt, it is extremely difficult to hold very close tolerances on the cross sectional size of the creaser belt. Therefore, the cross section of the creaser belt, as originally formed, varies along the length of the belt. During use, the creaser belt will tend to stretch due to tension on the belt and centrifugal effects. Of course, stretching of the creaser belt will change the cross sectional size of the belt.

The foregoing and other factors make it very difficult to maintain the effective pitch diameter of the pulleys around which the creaser belts extend constant during movement of the belts. Of course, if the effective diameter of the pulleys which engage the creaser belts vary during movement of the belts, the speed of movement of the creaser belts will vary. When the speeds of creaser belts vary, one of the belts will move further than the other belt. Thus, in a test, one creaser belt of a pair of creaser belts moved 1.25 inches further than the other belt in four feet of belt travel. Of course, if creaser belts engaging opposite sides of a signature travel through different distances, the signature will be deformed by the creaser belts.

SUMMARY OF THE INVENTION

The present invention relates to a new and improved sheet material handling apparatus having controls to accurately regulate the speed of movement of belts in the apparatus. When the sheet material handling apparatus is a folder, the sheet material may be moved by a first series of belts along a path extending between a pair of deflectors. A second series of belts grips the sheet material while it is being moved by the first series of belts and continues the movement of the sheet material along the deflectors. Signal generators provide speed signals which are functions of the speeds of movement of the first and second series of belts. A controller compares the speed signals and effects operation of a belt drive to vary the speed of movement of at least one belt in one of the series of belts in response to a change in relationship between the speed signals.

In one specific sheet material handling apparatus, the first series of belts includes a plurality of tapes which engage sheet material on opposite sides of a fold line. In this apparatus, the second series of belts includes a pair of creaser belts which are aligned with a fold line and engage the sheet material along opposite sides of the fold line. The speed of movement of the tapes and creaser belts is compared. The speed of movement of the creaser belts is varied during operation of the apparatus to maintain the speed of the creaser belts equal to the speed of the tapes. When the sheet material has been deformed before entering the apparatus, for example by a preceding folder, the creaser belts can be driven at slightly different speeds to eliminate the deformation.

Accordingly, it is an object of this invention to provide a new and improved sheet material handling apparatus having a plurality of belts and a controller which compares belt speed signals and effects operation of a belt drive to vary the speed of movement of at least one of the belts in response to a change in the relationship between the belt speed signals. Another object of this invention is to provide a new and improved sheet material handling apparatus in which the effective pitch diameters of pulleys for a pair of belts varies with movement of the belts and wherein a control assembly is operable to maintain a desired relationship between the speed of movement of the belts even though the effective pitch diameters of the pulleys varies.

BRIEF DESCRIPTION OF THE DRAWINGS

The foregoing and other features of the invention will become more apparent upon a consideration of the following description taken in connection with the accompanying drawings, wherein.

DESCRIPTION OF SPECIFIC PREFERRED EMBODIMENTS OF THE INVENTION

Folder Apparatus

Figure 1:
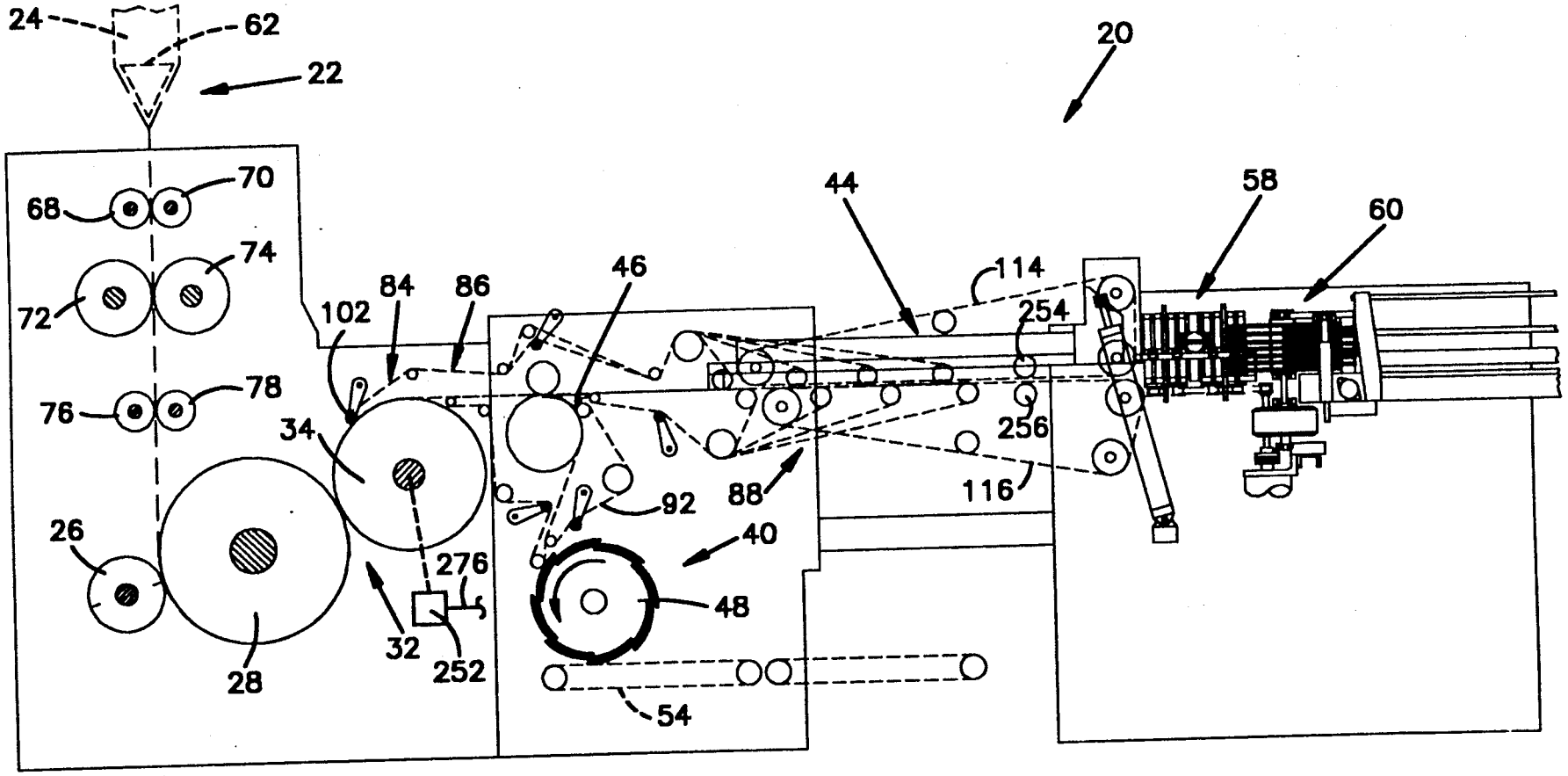
FIG. 1 is schematicized side elevational view of a sheet material handling apparatus constructed in accordance with the present invention.
Figure 8:
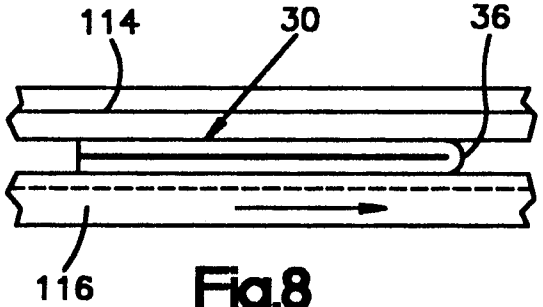
FIG. 8 is an enlarged schematic illustration depicting the manner in which a pair of creaser belts moving at the same speed engage and move folded sheet material without deforming the sheet material.

Although the present invention may be used in many different types of apparatus which handle sheet material, the invention is described herein in conjunction with a folder apparatus 20. The folder apparatus 20 (FIG. 1) includes a first folder assembly 22 in which a longitudinally extending fold is formed in a web 24. A cutting cylinder 26 cooperates with a tucking cylinder 28 to cut the folded web into a plurality of sheet material segments or signatures 30 (FIG. 8). In addition to the tucking cylinder 28, a jaw folder assembly 32 includes a gripper jaw or second folding cylinder 34 (FIG. 1). The second folding cylinder 34 cooperates with the tucking cylinder 28 to form a fold 36 (FIG. 8).

The signature 30 can move from the folder 32 to either a shingled stream delivery conveyor 40 or a third folder assembly 44 depending upon the position of a divert gate 46. When the divert gate 46 is in one position, the signatures 30 are conducted to a delivery wheel 48. The delivery wheel 48 deposits the twice folded signatures 30 in a shingled stream on a belt conveyor 54.

When the signature 30 is to be folded again, the divert gate 46 is set to direct the signatures to the third folder assembly 44. The third folder assembly 44 deflects the material of the signature 30 upwardly from a horizontal plane to fold the signature along a fold line extending perpendicular to the fold 36. The signature 30 moves from the third folder assembly 44 to a discharge or creaser roll assembly 58 which presses the signature to further set the folds in the signature. The folded signature 30 is discharged from the creaser roll assembly 58 to a stacker assembly 60 which stacks the signature in an on-edge orientation.

FIRST AND SECOND FOLDER ASSEMBLIES

The first folder assembly 22 folds the web 24. Thus, as the web 40 moves over former board 62 having a known construction, a fold is formed in the web 24 in a known manner. The folded web 24 enters the nip between a pair of pinch pullies or nip rollers 68 and 70 which set the fold. The folded web 24 then enters the nip between a pair of cross perforator rolls 72 and 74. The rolls 72 and 74 form perforations across the web in a direction perpendicular to the fold at spaced apart intervals on the web. The perforations let air out of the web and weakens the web to facilitate the subsequent forming of the fold 36 at the perforations.

After leaving the nip between the perforator rolls 72 and 74, the web 24 enters the nip between a pair of creaser rollers 76 and 78. The web then moves to a nip formed between the cutting cylinder 26 and the tucking cylinder 28. The cutting cylinder 26 has a pair of cutting elements which cut the web 24 twice in each revolution of the cutting cylinder 26. The cutting cylinder 26 cooperates with the tucking cylinder 28 to cut the web into lengths to form the signatures 30 by cutting the web midway between transverse perforations formed by the perforator cylinders 72 and 74. At this time, a signature 30 formed by the cooperation between the cutting cylinder 26 and tucking cylinder 28 has only a single fold, that is the fold formed in the first folder assembly 22.

The tucking cylinder 28 has impaling ends which engage the leading end portion of the web 24 before the web is cut by the cylinder 26. Cutting irons are disposed on the tucking cylinder 28. The cutting irons cooperate with blades on the cutting cylinder 26 to cut the web after the leading end portion of the web has been engaged by the impaling pins on the tucking cylinder.

The tucking cylinder 28 cooperates with a jaw cylinder 34 to make the second fold 36. A fold is formed crosswise of the signature 30, that is in a direction perpendicular to the path of travel of the signature around the tucking cylinder 28. The second fold 36 is formed when a tucking blade on the cylinder 28 presses the sheet material into an open jaw on the jaw cylinder 34. Although any desired number of sets of impaling pins, cutting irons and tucking blade units could be provided on the tucking cylinder 28, in one specific instance, the cylinder 28 was provided with five sets of impaling pins, five cutting irons and five sets of tucking blades. The jaw cylinder 34 is smaller than the tucking cylinder 28 and has only four sets of jaws. Of course, the jaw cylinder 34 could be provided with any desired number of jaws.

The tucking cylinder 28 and jaw cylinder 34 cooperate to sequentially form the folds 36 at the locations where the web was perforated by the cross perforator cylinders 72 and 74. The manner in which the folds 36 are formed across the signature 30 by the cooperation between the tucking cylinder 28 and jaw cylinder 34 is well known and will not be further described herein to avoid prolixity of description.

The signatures 30 are continuously gripped. Thus, a signature 30 is gripped between the jaw cylinder 34 and a first series 84 of belts while the signature is still under the control of the jaw cylinder 34. The first series 84 of belts includes a plurality of upper tapes 86 and a plurality of lower tapes 88. The leading end portion of a signature 30 is then gripped between upper and lower tapes of the first series 84 of belts while the trailing portion of the signature is still gripped between the upper tapes 86 and the jaw cylinder 34.

When the divert gate 46 is raised, the signatures 30 are conducted by tapes, 92 to the fan wheel 48. The delivery fan wheel 48 rotates in a counterclockwise direction (as viewed in FIG. 1) and deposits the signatures in a lapped stream on the belt conveyor 54. Although the option of having the signatures delivered in a lapped stream onto the belt conveyor 54 with only the two folds formed in the signatures is provided, this manner of operating the folder apparatus 20 is not, itself, a feature of the invention.

THIRD FOLDER ASSEMBLY

The third folder assembly 44 (FIGS. 2 and 3) is operable to form the folds in the signatures 30 as the signatures move from a wide inlet end portion 96 of the folder assembly 44 to a narrow outlet or discharge end portion 98 of the third folder assembly 44. To assist the folder assembly 44 in accurately forming the folds extending in the direction of travel of the signatures 30 through the folder assembly and perpendicular to the folds 36, a creaser roller 102 (FIG. 1) cooperates with the jaw cylinder 34 to form creases in the signatures 30 at the locations where the folds are to be located.

The third folder assembly 44 (FIG. 2) includes the upper and lower tapes 86 and 88 which form the first series 84 of belts. The upper tapes 86 extending from the jaw cylinder 34 (FIG. 1) through the relatively wide inlet portion 96 of the folder assembly 44 toward the relatively narrow outlet portion 98 (FIG. 3). The array or series 84 of tapes tapers from the wide inlet portion 96 toward the narrow outlet portion 98 of the folder assembly 44. It should be understood that some of the tapes in the upper and lower portions (as viewed in FIG. 2) of the array 84 of tapes have been broken away in FIG. 3 to more fully expose the components of the folder assembly 44. However, in the folder assembly 44, the tapes in the upper portion (as viewed in FIG. 2) of the series or array 84 of tapes are generally a mirror image of the tapes 88 in the lower portion of the array.

Figure 2:
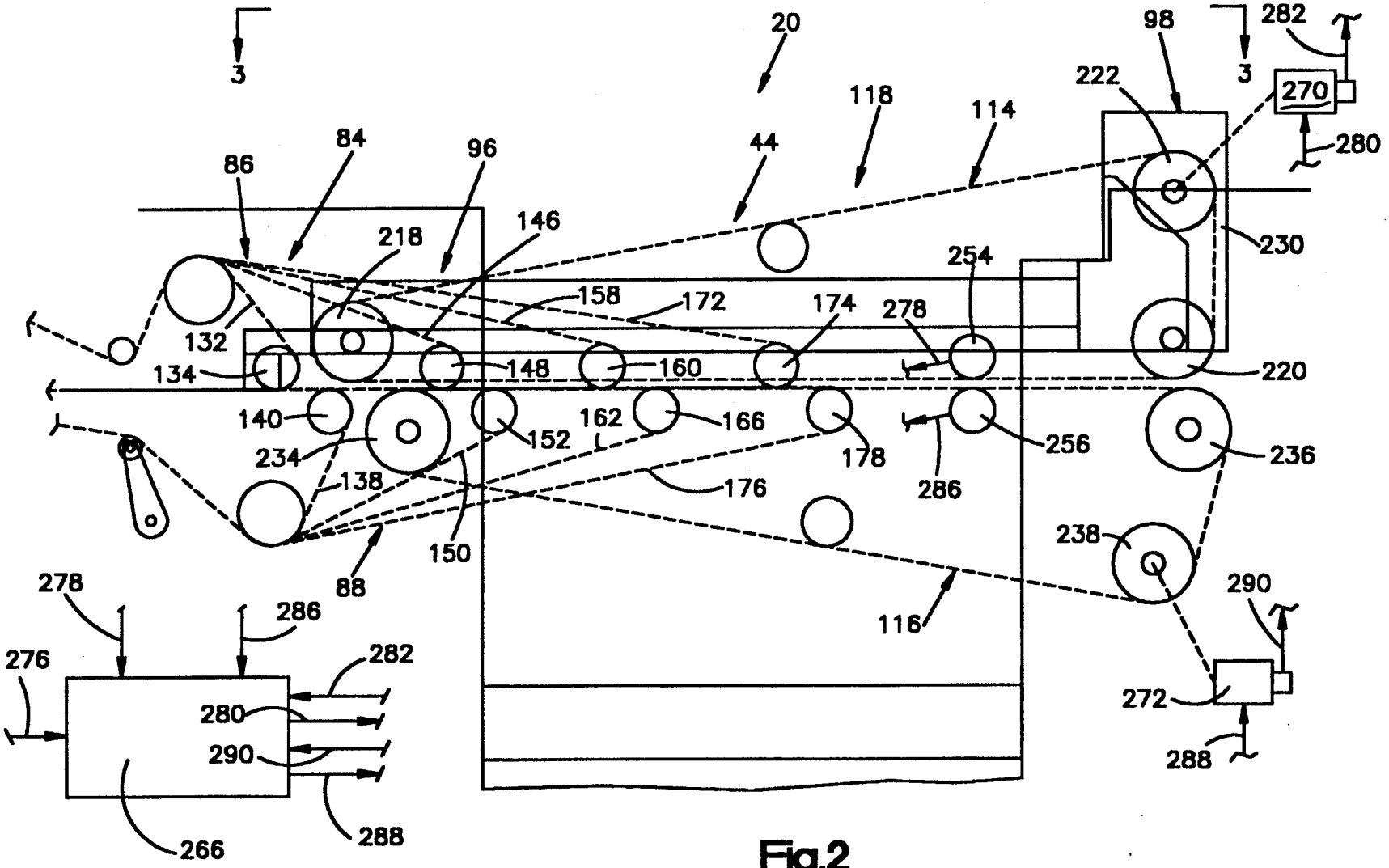
FIG. 2 is an enlarged schematic illustration of a folder assembly which forms a portion of the sheet material handling apparatus of FIG. 1.
Figure 3:
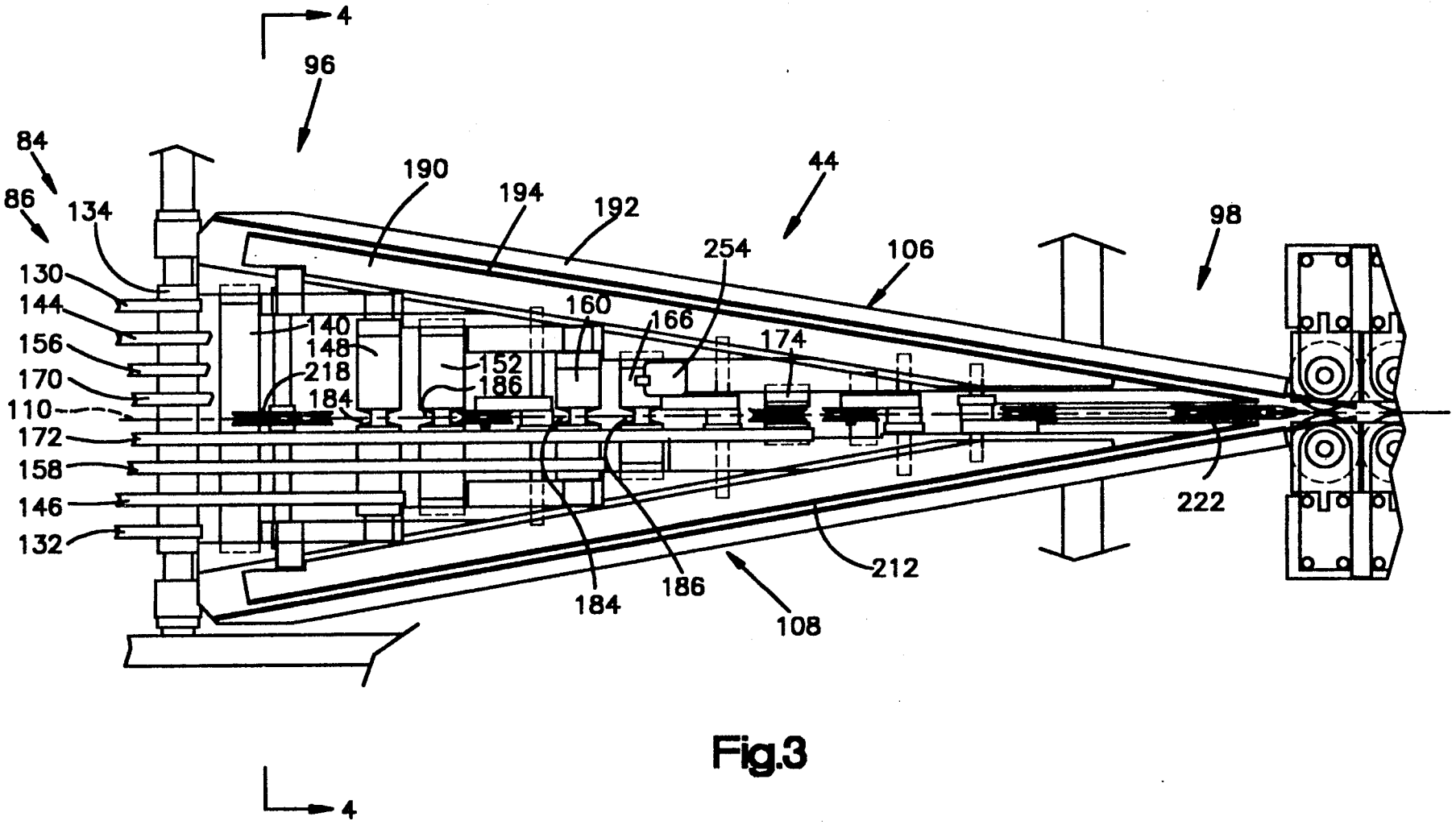
FIG. 3 is a plan view, taken generally along the line 3—3 of FIG. 2, illustrating in the relationship between a pair of longitudinally extending deflectors which engage opposite sides of sheet material being moved by a tapered array of belts and/or a pair of creaser belts.

The array or series 84 of tapes includes the plurality of upper tapes 86 and a plurality of lower tapes 88 (FIG. 2). The upper tapes 86 engage the signatures 30 on the jaw cylinder 34 (FIG. 1). The upper tapes 86 cooperate with the jaw cylinder 34 to securely grip the signatures 30 before they leave the jaw cylinder 34. The tapes 86 and 88 firmly grip the signatures 30 during movement of the signatures to the inlet portion 96 of the folder assembly 44. The tapes 86 and 88 also grip the signatures as they move toward the outlet portion 98 of the folder assembly 44.

In the folder assembly 44, the upper tapes 86 (FIG. 2) cooperate with the lower tapes 88 to form a flat base (FIG. 3). The tapes 86 and 88 hold the portion of the signatures 30 between the upper and lower tapes 86 and 88 flat in a horizontal plane. Since the array 84 of upper and lower tapes 86 and 88 tapers longitudinally of the folder assembly 44 (FIG. 3), the distance for which the flat horizontal areas of the signatures extend outwardly from a longitudinal center line 110 (FIG. 3) of the conveyor assembly 44 decreases as the signatures move along the array of tapes. Even though the extent of the area of engagement of the tapered array 84 of upper and lower tapes 86 and 88 with the opposite major side surfaces of the signatures 30 decreases along the path of movement of the signatures through the folder assembly 44, the portion of the signatures engaged by the tapered array 84 of tapes is firmly gripped and maintained flat in a horizontal plane by the cooperation between the upper and lower tapes 86 and 88.

A pair of converging formers 106 and 108 (FIG. 4) are disposed on opposite sides of the longitudinally extending center line of the folder assembly 44. The formers 106 and 108 deflect portions of the signatures 30 upwardly on opposite sides of the central axis 110 of the folder 44 (FIG. 3). The formers 106 and 108 extend from the relatively wide entrance end portion 96 of the folder assembly 44 to the narrow outlet end portion 98 of the folder assembly (FIG. 3).

As a signature 30 is moved from left to right (as viewed in FIG. 3) through the folder assembly 44 and the size of the base formed by the array 84 of belts or tapes decreases, the formers 106 and 108 engage an increasingly large area of the signature. As the area of a signature 30 engaged by the formers 106 and 108 increases, the formers smoothly cam or deflect the signature upwardly on opposite sides of a fold line coincident with the central axis 110 of the folder 44.

When a signature 30 is moved into the relatively wide entrance portion 96 (FIG. 3) of the folder assembly 44 by the upper and lower tapes 86 and 88 (FIG. 4), the signature is flat in a horizontal plane. The fold 36 (FIG. 8) forms the leading edge portion of the signature. The fold 36 extends perpendicular to the longitudinal axis 110 of the folder assembly 44 and the direction of movement of the signature 30 through the folder assembly.

As the upper and lower tapes 86 and 88 move a signature rightwardly (as view in FIG. 3) from the entrance 96 to the folder assembly 44, opposite outer edge portions of the signature engage the formers 106 and 108 which deflect or bend the outer edge portions of the signature upwardly without permanently deforming the signature. As the signature 30 continues to move into the folder assembly 44, the transverse extent of the first series 84 of the belts decreases and the extent of engagement of the signatures with the formers 106 and 108 increases as opposite sides of the signatures are moved toward each other along the central fold line. As the signature 30 enters and moves through the outlet end portion 98 of the folder 33, the folds are completed.

At or shortly after the inlet or entrance portion 96 of the third folder assembly 44, upper and lower creaser belts 114 and 116 (FIG. 2) of a second series 118 of belts engage opposite sides of the signature 30 at the location where the folds are to be formed, that is along the central axis 110 of the folder 44. The creaser belts 114 and 116 extend along the central axis 110 of the folder assembly 44. The creaser belts 114 and 116 extend from the inlet portion 96 of the folder assembly 44 to the outlet end portion 98 of the folder assembly. The upper and lower creaser belts 114 and 116 maintain a firm grip on opposite sides of each of the signature 30 at the fold before and after the signature has moved past the end of the tapered array 84 of upper and lower tapes 86 and 88. This results in the signatures moving in a controlled manner through the folder assembly 44, first under the influence of the tapes 86 and 88 of the first series 84 of belts and then under the influence of the creaser belts 114 and 116 of the second series 118 of belts.

Figure 5:
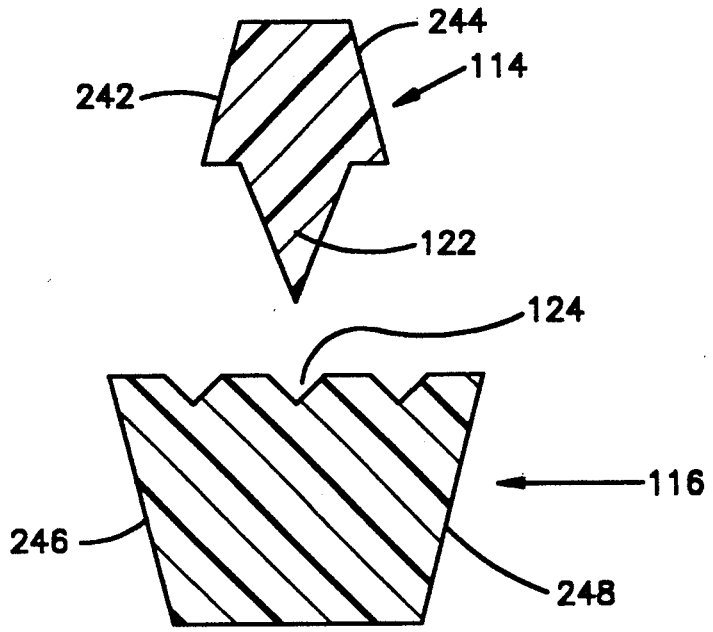
FIG. 5 is an enlarged cross sectional view of the creaser belt.

In addition to promoting movement of the signatures 30 through the folder assembly 44 in a controlled manner, the upper and lower creaser belts 114 and 116 crease the signatures to make certain that the folds are formed at the desired location on the signature. Thus, the upper creaser belt 114 has a longitudinally extending tapered nose 122 (FIG. 5) which cooperates with a longitudinally extending groove 124 in the lower creaser belt 116. The nose 122 of the upper creaser belt 114 cooperates with the groove 124 in the lower creaser belt 116 to maintain a crease in the signature 30 at the location where a fold is to be formed and to securely hold the signature against sidewise movement relative to the longitudinal central axis 110 of the folder assembly 44.

Figure 4:
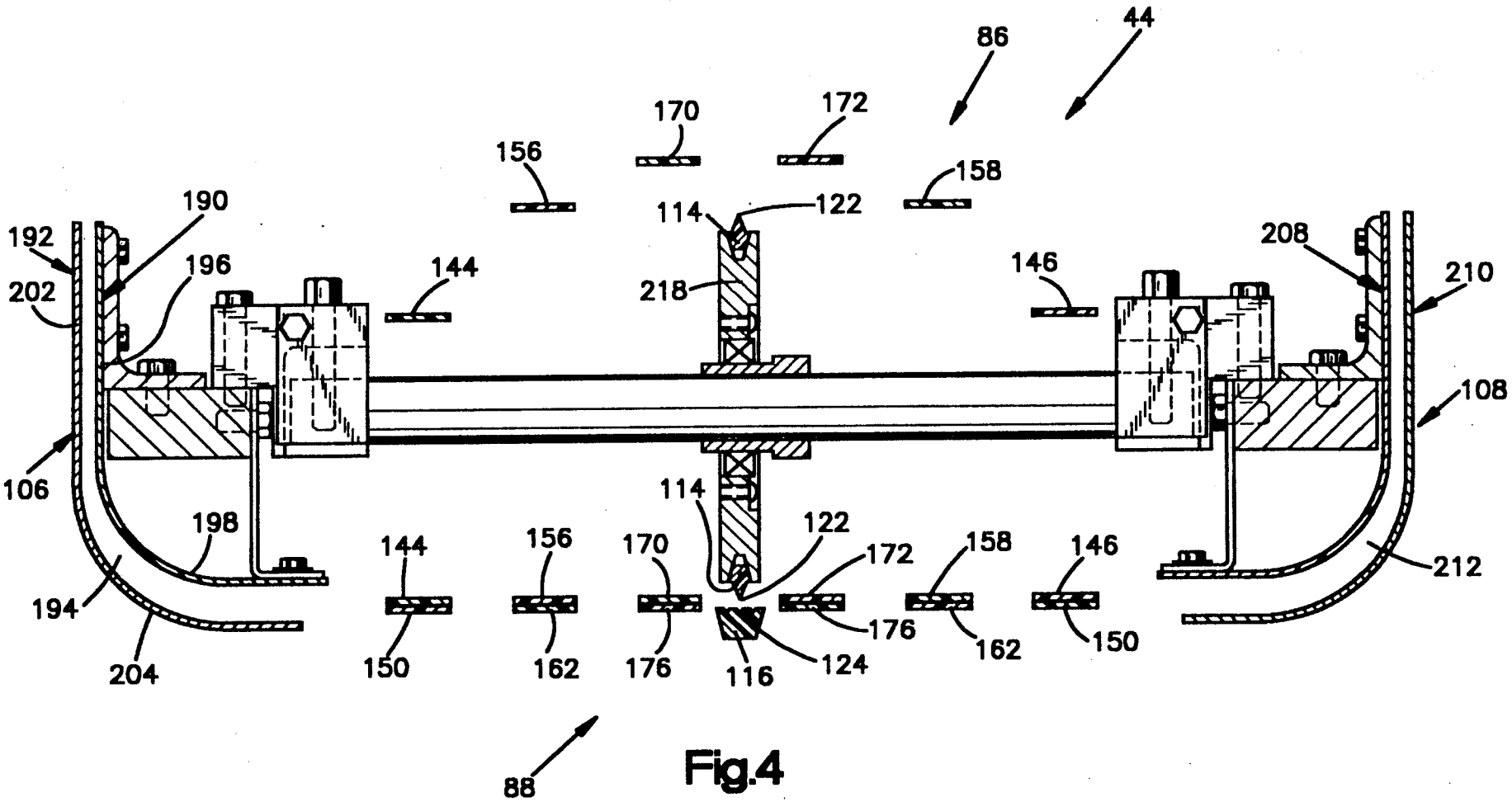
FIG. 4 is a sectional view, taken generally along the line 4—4 of FIG. 3, further illustrating the relationship between the longitudinally extending deflectors, belts of the tapered array of belts and the pair of creaser belts.

The upper tapes 86 have lower runs with flat horizontal side surfaces which engage the upper major side surface of a signature in the third folder assembly 44. Similarly, the lower tapes 88 have upper runs with flat horizontal side surfaces which engage the lower side of a signature in the third folder assembly 44 at a location opposite from an upper tape (FIG. 4). The signature 30 is firmly gripped between the horizontal lower runs of the upper tapes 86 and the horizontal upper runs of the lower tapes 88.

The upper tapes 86 include a pair of tapes 130 and 132 which extend around an upper roller 134 (FIG. 3). Similarly, a pair of lower tapes, indicated at 138 in FIG. 2, extend around a lower roller 140 and are disposed opposite from and are aligned with the upper tapes 130 and 132.

A second pair of upper tapes 144 and 146 (FIGS. 3 and 4) extend around an upper roller 148 (FIG. 3). Although the tapes 144 and 146 extend past the roller 134 to the roller 148 (FIG. 3), an upper side surface of the lower runs of the tapes 144 and 146 engage and are positioned by a cylindrical outer side surface of the roller 134. A pair of lower tapes 150 (FIGS. 2 and 4) cooperate with the upper tapes 144 and 146 and extend around a lower roller 152.

A third pair of upper tapes 156 and 158 extend around a roller 160 and have horizontal lower runs which cooperate with a pair of lower tapes 162 which extend around a lower roller 166 (FIG. 2). Finally, a central pair 170 and 172 (FIGS. 3 and 4) of upper tapes extend around a roller 174 and cooperate with a pair of lower tapes indicated at 176 in FIG. 2. The lower tapes 176 extend around a lower roller 178. The horizontal lower runs of the tapes 170 and 172 are positioned relative to the horizontal upper runs of the lower tapes 176 by cylindrical side surfaces of each of the rollers 160, 148 and 134. Similarly, horizontal upper runs of the lower pair of tapes 176 are positioned relative to the upper tapes 170 and 172 by the rollers 116, 152 and 140.

The upper creaser belt 114 (FIG. 2) extends past the upper rollers 148, 160 and 174. Therefore, these rollers are provided with annular central grooves 184 to accommodate the upper creaser belt 114 in the manner illustrated in FIG. 3 for the roller 148. Similarly, the lower creaser belt 116 extends past the rollers 152, 166 and 178 (FIG. 2). Therefore, each of these rollers is also provided with an annular central groove 186 to accommodate the lower creaser belt 116 in the manner shown in FIG. 3.

The two formers 106 and 108 (FIG. 3) engage areas of the signature on opposite sides of the longitudinal center line 110 of the folder assembly 44. The extent of engagement of the formers 106 and 108 with the sheet material of the signatures 30 increases as the extent of engagement of the tapered array or series of belts 84 decreases. The former 106 includes an inner former wall 190 and an outer former wall 192 (FIG. 4). A longitudinally extending space 194 is provided between the inner and outer former walls 190 and 192. During operation of the folder assembly 44, portions of the signatures 30 move through the space 194.

The inner former wall 190 has an upright or vertical side section 196 (FIG. 4) and an arcuately curving lower section 198. Similarly, the outer former wall 192 has an upright side section 202 and an arcuately curving lower section 204. The upright side section 202 of the outer former wall 192 extends parallel to the side section 196 of the inner former wall 190. The arcuate lower sections 198 and 204 of the former walls 190 and 192 have different radii of curvature. Therefore, the signature receiving space 194 tapers from a relatively wide entrance between the lower side sections 198 and 204 to the relatively narrow space between the upright side sections 196 and 202.

The former 108 (FIG. 4) has a configuration which is a mirror image of the configuration of the former 106. Thus, the former 108 includes an inner side wall 208 and an outer side wall 210. A space 212 is provided between the inner and outer side walls 208 and 210 to receive a portion of a signature.

As the two formers 106 and 108 converge toward each other along the longitudinal axis 110 of the folder assembly 44 (FIG. 3), the extent of a signature received in the spaces 194 and 212 between the former side walls increases. As the former walls converge, the arcuate lower sections of the former walls approach each other. However, before the lower sections meet, the arcuate lower sections of the walls are merged or blended into the vertical upright sections of the walls.

The upper creaser belt 114 extends from a rear pulley or sheave 218 (FIGS. 2, 3, and 4), forwardly to a lower front sheave or pulley 220 (FIG. 2). The upper creaser belt 114 then extends around an upper sheave or pulley 222 back to the rear sheave 218. It should be noted that although the sheaves 218 and 222 have been shown in FIG. 3, the upper creaser belt 114 has been omitted in FIG. 3 in order to more fully illustrate the components of the folder assembly 44.

The inner former side walls 190 and 208 (FIG. 4) are disposed adjacent or abut supports 230 for the lower front creaser belt pulley 220. This results in the portions of the signature 30 disposed on opposite sides of the fold moving as closely as possible together at the portions of the formers 106 and 108 disposed adjacent to the forward creaser belt pulley 220.

The lower creaser belt 116 (FIG. 2) extends from a rear pulley or sheave 234 (FIG. 2) forwardly to an upper front sheave or pulley 236. The lower creaser belt 116 then extends downwardly around a lower sheave or pullely 238 and back to the rear sheave 234.

The upper and lower creaser belts 116 and 118 have horizontally extending runs which engage opposite sides of sheet material being moved by the creaser belts. Thus, a horizontally extending run of the lower creaser belt 116 extends between the pulley 234 and 236. This horizontal run of a lower creaser belt 116 cooperates with a horizontally extending run of the upper creaser belt 118 extending between the pulleys 218 and 220. The horizontally extending runs of the upper and lower creaser belts 114 and 116 grip the sheet material along the fold line to enable the longitudinally extending nose portion 122 on the upper creaser belt 114 to cooperate with the longitudinally extending groove 124 formed in the lower creaser belt 116 to maintain a crease in the sheet material at a location disposed along the central axis 110 of the folder 44. The cooperation between the nose portion 122 of the upper creaser belt 114 and the groove 124 in the lower creaser belt 116 securely holds the sheet material against sidewise movement relative to the creaser belts as the sheet material is moved away from the tapered array 84 of belts towards the outlet 98 by the creaser belts.

The folder assembly has the same construction as is described in copending U.S. patent application filed by Richard E. Breton and David B. Staley and entitled "Folder Apparatus".

BELT SPEED CONTROLS

During operation of the folder 44, the effective pitch diameter of the upper creaser belt drive pulley 222 and the effective pitch diameter of the lower creaser belt drive pulley 238 (FIG. 2) will vary. The variation in the pitch diameters of the creaser belt drive pulleys 222 and 238 is the result of many different factors. The principle factor causing the variation in the effective pitch diameters of the creaser belt pulleys is a variation in the cross sectional size of the upper and lower creaser belts 114 and 116.

The creaser belts 114 and 116 are of the well known V-type. Thus, the upper creaser belt 114 has a pair of inwardly tapering side surfaces 242 and 244 (FIG. 5) which engage similarly tapered side surfaces of the upper creaser belt pulleys 218, 220 and 222 (FIG. 2). Similarly, the lower creaser belt 116 has a pair of inwardly tapering side surfaces 246 and 248 (FIG. 5) which engage similarly tapered side surfaces of the lower creaser belt pulleys 234, 236, and 238 (FIG. 2}. Due to manufacturing tolerances, the cross sectional size of the upper and lower creaser belts 114 and 116 will vary somewhat along the length of the belts. In addition, the belts will tend to stretch during use and will be subjected to centrifugal forces.

Due to the cooperation between the side surfaces 242, 244, 246, and 248 (FIG. 5) of the upper and lower creaser belts 114 and 116 with the similarly tapering surfaces of V-grooves in the creaser belt drive pulleys 222 and 238, even a small variation in the distance between the side surfaces and one of the creaser belts results in a relatively large shift in the center line of the belt relative to a pulley. This results in a change in the effective pitch diameter of the creaser belt pulley. If uncompensated for, changes in the effective pitch diameters of the creaser belt drive pulleys 222 and 238 results in corresponding changes in the speed of movement of the creaser belts 114 and 116. By experimentation, it has been determined that with commercially available creaser belts 114 and 116, the variation in cross sectional size of the creaser belts can result in one of the creaser belts travelling more than an inch further than the other creaser belt during movement of sheet material through a distance of approximately four feet.

In accordance with a feature of the present invention, the speed of movement of the creaser belts 114 and 116 in the second series 118 of belts are accurately coordinated with each other and with the speed of movement of the upper and lower tapes 86 and 88 in the first series 84 of belts. The first series 84 of belts is driven off of the main drive for the sheet material handling apparatus 20. Thus, the speed of movement of the first series 84 of belts will vary with variations in the speed of rotation of the tucking cylinder 28 and jaw cylinder 34 (FIG. 1).

Figure 6:
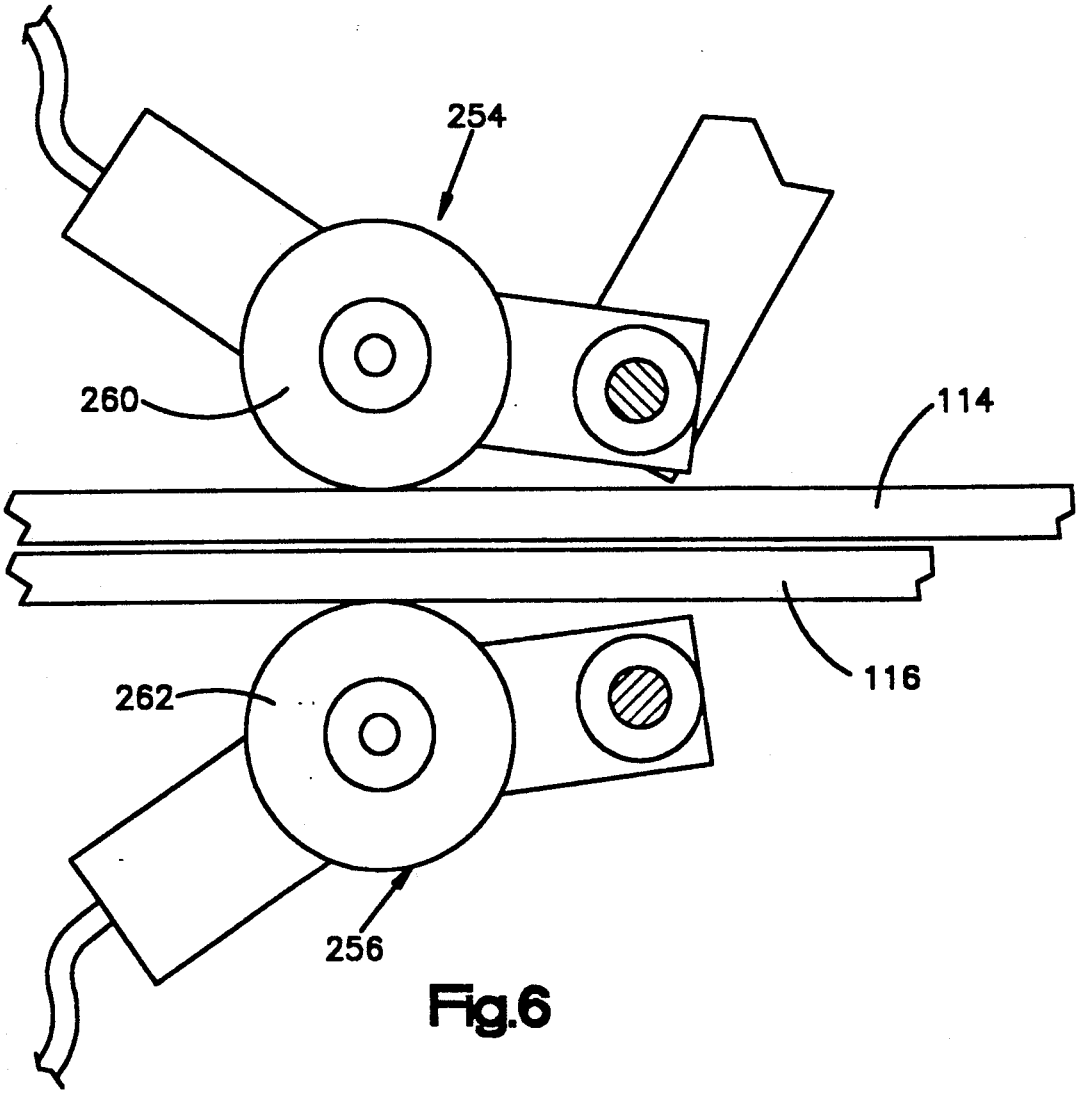
FIG. 6 is an enlarged view illustrating the manner in which a pair of speed signal generators cooperate with the creaser belts to provide output signals which are a function of the speed of the creaser belts.

A tape speed signal generator 252 is connected with the central axis for the jaw cylinder 34 and provides an output signal which is a function of the speed of movement of the upper and lower tapes 86 and 88. An upper creaser belt speed signal generator 254 (FIGS. 1, 2, and 6) provides a speed signal which is a function of the speed of movement of the upper creaser belt 114. A lower creaser belt speed signal generator 256 provides a speed signal which is a function of the speed of movement of the lower creaser belt 116. The signal generators 252, 254 and 256 are tachometers which provide output voltages indicative of the speeds of the belts 84, 114 and 116.

The creaser belt speed signal generators 254 and 256 engage straight runs of the upper and lower creaser belts 114 and 116 (FIG. 2) to minimize the extent to which the creaser belts extend or wrap around pulleys 260 and 262 which engage the upper and lower creaser belts 114 and 116. This is to reduce the extent to which variations in the cross section of the creaser belts 114 and 116 effect the output of the speed signal generators 254 and 256. In addition, if the creaser belts were wrapped around the pulleys 260 and 262 to any substantial extent, the difference in the speed of movement of the inner side surfaces of the creaser belts relative to the outer side surfaces of the creaser belts would effect the output of the speed signal generators.

Figure 7:
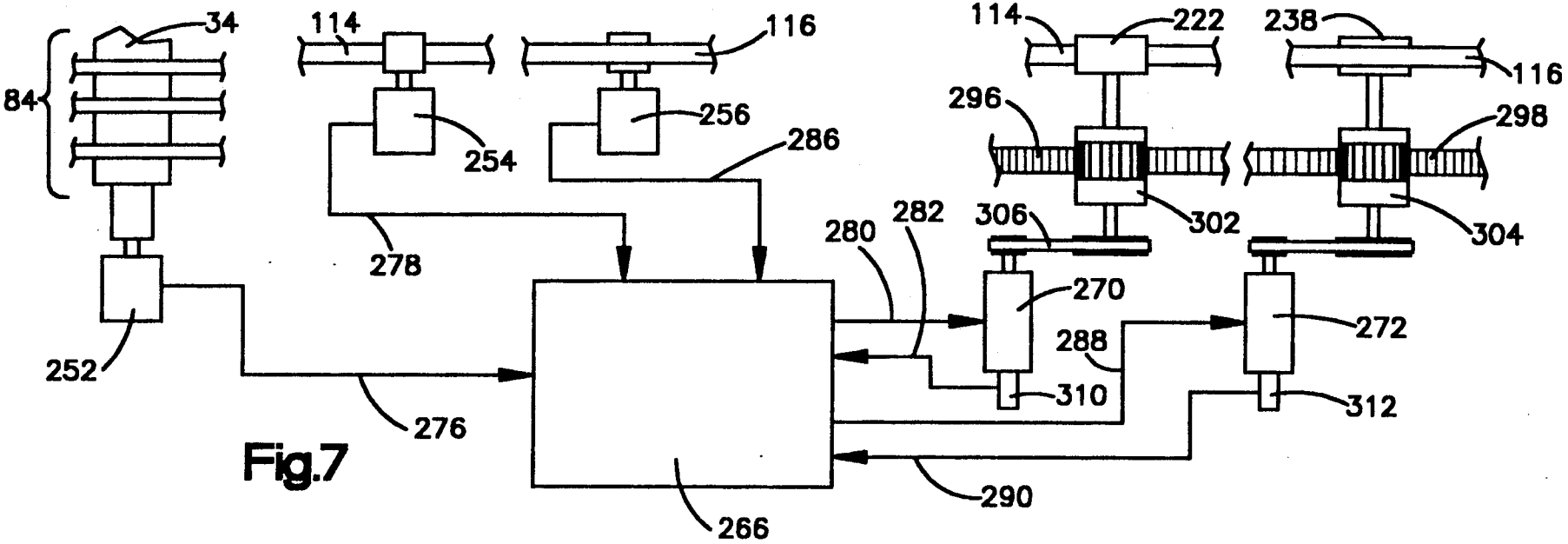
FIG. 7 is a schematic illustration depicting the relationship between the creaser belt speed signal generators of FIG. 6, a signal generator for providing a signal corresponding to the speed of movement of the tapered array of belts, and controls for varying the speed of movement of the creaser belts.

A controller 266 (FIGS. 2 and 7) compares the speed signals from the signal generators 252, 254 and 256 (FIGS. 1 and 7). The controller 266 effects operation of reversible upper and lower creaser belt drive motors 270 and 272 (FIGS. 2 and 7) to vary the speed of movement of the upper and lower creaser belts 114 and 116. The controller 266 energizes the motors 270 and 272 in response to a change in a relationship between the speed signals received by the controller from the signal generators 252, 254, and 256.

The controller 266 receives a speed signal from the tachometer or signal generator 252 over a lead 276 (FIG. 7). This signal corresponds to the speed of movement of the first series of belts 84. The controller 266 also receives a speed signal from the tachometer or signal generator 254 over a lead 278. This signal corresponds to the speed of the upper creaser belt 114.

The controller continuously compares the speed of the upper creaser belt 114 to the speed of the first series of belts 84. If the upper creaser belt speed signal from the signal generator 254 does not correspond to a speed which is a predetermined function of the first belt speed signal from the signal generator 252, the controller 266 provides an output over a lead 280 to energize the upper creaser belt drive motor 270 (FIG. 7). A feedback signal is conducted over a lead 282 from the upper creaser belt drive motor 270 to the controller 266 to indicate to the controller that the drive motor 270 has responded in the manner directed by the controller. During operation of the folder 44, the controller 266 continuously compares the speed of movement of the upper creaser belt 114 to the speed of movement of the first series of belts 84 to maintain a preselected relationship between the speed of movement of the upper creaser belt 114 and the first series of belts 84 even though the cross sectional area of the creaser belt 114 and the effective pitch diameters of the creaser belt pulleys 218, 220, and 22 (FIG. 2) varies.

The controller 266 (FIG. 7) also continuously compares the speed of movement of the lower creaser belt 116 with the speed of movement of the first series 84 of belts to maintain a predetermined relationship between the speed of movement between the lower creaser belt 116 and the tapes in the first series 84 of belts. Thus, the controller 266 receives a lower creaser belt speed signal from the belt speed sensor 256 over a lead 286. The lower creaser belt speed signal is continuously compared with the first belt speed signal from the signal generator 252. If the speed of movement of the lower creaser belt 116 varies from a predetermined function of the speed of the first series 84 of belts, the controller 266 transmits an output over a line 288 to energize the reversible lower creaser belt drive motor 272 to vary the speed of movement of the lower creaser belt 116. A feedback signal is conducted over the lead 290 from the motor 272 to the controller 266.

Since the controller 266 continuously compares the speeds of the upper and lower creaser belts 114 and 116 to the speed of the first series 84 of belts, the upper and lower creaser belt speeds are effectively compared to each other. However, the controller 266 could be constructed in such a manner as to directly compare the upper and lower creaser belt speeds to each other as well as to the speed of the first series 84 of belts if desired. The controller 266 is commercially available from CSR Division, Cleveland Machine Controls, Inc. The controller, in general, consists of two motion control loops or circuits, one for each creaser belt 114 and 116. Each loop output controls an individual servo drive module and motor. Discrete inputs and outputs for general folder controls are utilized for safety and system interlock purposes. However, other controllers could be utilized if desired.

The upper and lower creaser belts 114 and 116 are usually driven at the same speed by the drive pulleys 222 and 238. This results in the creaser belts 114 and 116 moving the opposite sides of the signature 30 at the same speed (FIG. 8). When the opposite sides of the signature 30 are moving at the same speed, the folded edge 36 of the signature leading the major sides of the signature are straight as viewed along the central axis 110 of the folder 44. Of course, the signature 30 is being deflected by the formers 106 and 108 as the signature is being moved by the upper and lower creaser belts 114 and 116.

Figure 9:
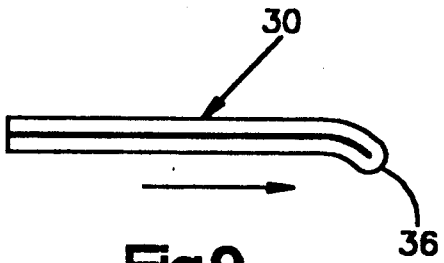
FIG. 9 is a schematic illustration, generally similar to FIG. 8, depicting the manner in which sheet material may have been deformed before being engaged by the creaser belts.

The upper and lower creaser belts 114 and 116 may intentionally be driven at slightly different speeds to deflect the signature 30 in such a manner as to eliminate unwanted deformation from the sheet material. Thus, operation of the jaw folder cylinder 34 may result in the signature 30 being deformed downwardly adjacent to the fold 36 in the manner illustrated in FIG. 9. By driving the lower creaser belt 116 at a slightly greater speed than the upper creaser belt 114, the lower side of the signature will be advanced relative to the upper side to remove the unwanted downward deformation from the signature 30.

Figure 10:
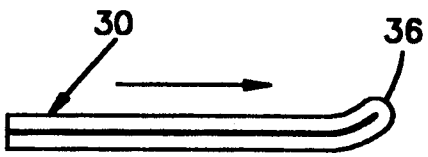
FIG. 10 is a schematic illustration, generally similar to FIG. 9, illustrating another way in which sheet material may have been deformed before being engaged by the creaser belts.

Similarly, if operation of the jaw folder results in the signature being deformed upwardly adjacent to the fold, in the manner shown in FIG. 10, the upper creaser belt 114 would be driven at a slightly greater speed than the lower creaser belt 116. This would result in the upper side of the signature 30 being advanced relative to the lower side to eliminate the unwanted upward deformation from the signature. It is contemplated that the intentional mismatch of the upper and lower creaser belts speeds will be relatively small. Thus, the amount of mismatch in the speed of movement of the creaser belts 114 and 116 may result in one side of the signature 30 being advanced by approximately 0.25 inches relative to the other side of the signature in approximately four feet of travel.

In the embodiment of the invention illustrated in FIG. 7, the upper and lower creaser belts 114 and 116 are driven from the main drive for the folder apparatus 20. The main drive has been indicated schematically, by gears 296 and 298 in FIG. 7. The gears 296 and 298 drive the creaser belt pulleys 222 and 238 through harmonic drive units 302 and 304.

If the reversible motors 270 and 272 are maintained in a de-energized condition by the controller 266, the main drive forces are transmitted directly through the harmonic drive units 302 and 304 to drive pulleys 222 and 238. However, if the motor 270 is energized, force is transmitted from the motor by belt drive 306 to the harmonic drive unit 302. The drive force transmitted from the motor 270 to the harmonic drive unit 302 modifies the main drive force input from the gear 296 to either increase or decrease the speed of rotation of the upper creaser belt drive pulley 222, depending upon the direction of operation of the reversible motor 270.

The general construction and mode of operation of the harmonic drive unit 302 is the same as is described in U.S. Pat. No. 3,724,368 issued Apr. 3, 1973 and entitled "Harmonic Drive Register Adjustment Device For A Printing Press". It should be understood that the harmonic drive unit 302 functions in a manner which is generally similar to that of a differential gear mechanism. Thus, other known types of drive units could be used to vary the speed of the rotation of the upper creaser belt drive pulley 220 as a function of operation of the motor 270. Although other types of feedback devices could be used, in the embodiment of the invention illustrated in FIG. 7, a tachometer 310 is used to provide a feedback signal to the controller 266.

The drive forces for the lower creaser belt drive pulley 238 are modified by the harmonic drive unit 304 in the same manner as previously described in conjunction with the harmonic unit 302. A tachometer 312 is connected with the motor 272 to provide a feedback signal to the controller 266.

Figure 11:
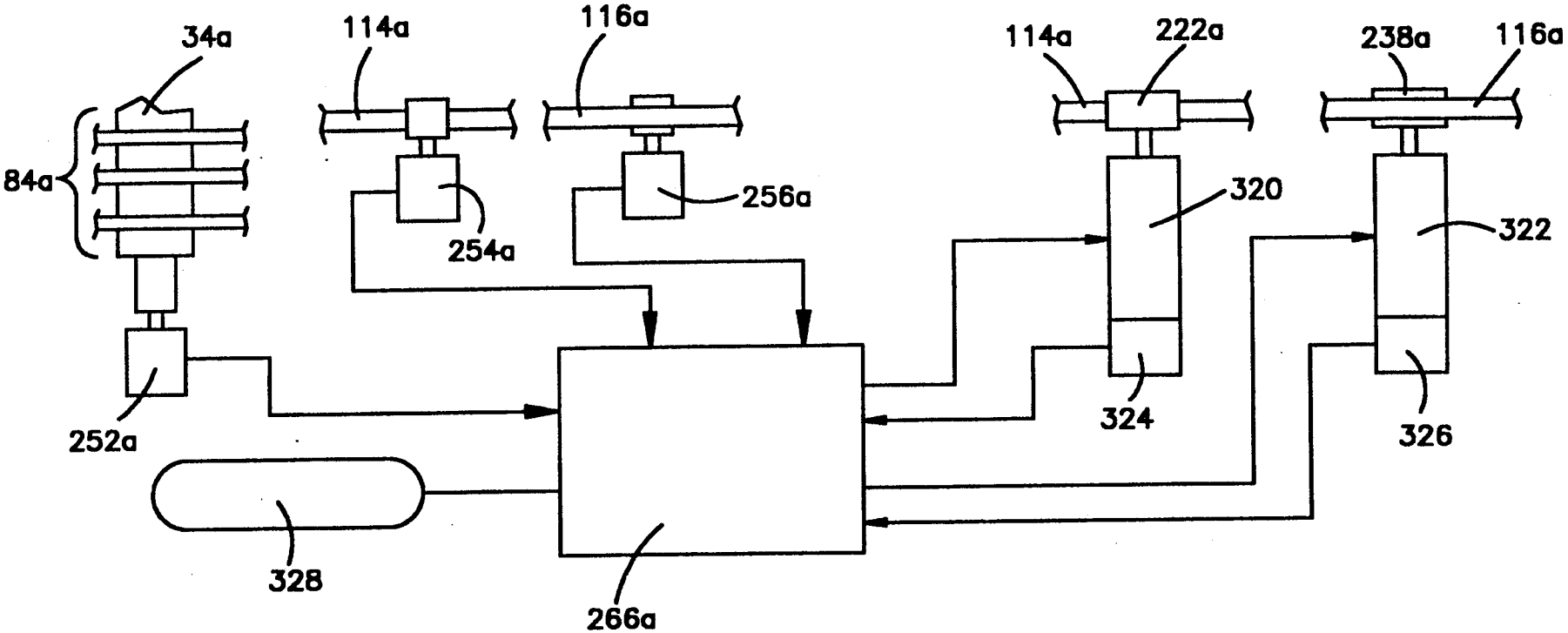
FIG. 11 is a schematic illustration, generally similar to FIG. 7, illustrating a second embodiment of the belt speed control apparatus.

In the embodiment of the invention illustrated in FIG. 11, separate motors are utilized to drive the upper and lower creaser belts independently of the main drive for the folder apparatus 20. In addition, encoder or pulse generator type feedback devices are utilized rather than tachometers. Since the embodiment of the invention illustrated in FIG. 11 is generally similar to the embodiment of the invention illustrated in FIGS. 1–10, similar numerals will be used to designate similar components, the suffix letter "a" being added to the numerals of FIG. 11 to avoid confusion.

In the embodiment of the invention illustrated in FIG. 11, a pair of motors 320 and 322 are connected directly to the upper and lower creaser belt drive pulleys 222*a* and 238*a*. The controller 266*a* varies the output speed of the motors 320 and 322 to directly vary the speed of movement of the upper and lower creaser belts 114*a* and 116*a*. Encoder or pulse generator type feedback devices 324 and 326 are connected with the controller 266*a* to provide a feedback signal indicative of the output speed of the motors 320 and 322. If desired, the signal generators 254*a* and 256*a* could provide feedback directly to the motors 320 and 322.

A control terminal 328 is connected with the controller 266*a* to provide a display indicative in the manner in which the speeds of the upper and lower creaser belts 114*a* and 116*a* are varying. The control terminal 328 also enables the speed relationship between the upper and lower creaser belts 114*a* and 116*a* to be adjusted relative to each other. Thus, the motors 320 and 322 can be operated to drive the creaser belts 114*a* and 116*a* at the same speed or at slightly different speeds.

CONCLUSION

In view of the foregoing description, it is apparent that the present invention relates to a new and improved sheet material handling apparatus 20 having controls (FIGS. 7 and 11) to accurately regulate the speed of movement of belts 84, 114, and 116 in the apparatus. When the sheet material handling apparatus 20 is a folder 44, the sheet material 30 may be moved along a path extending between a pair of deflectors 106 and 108 by a first series of belts 84. A second series of belts 114 and 116 grips the sheet material 30 while it is being moved by the first series of belts 84 and continues the movement of the sheet material along the deflectors 106 and 108. Signal generators 252, 254 and 256 provide speed signals which are functions of the speeds of movement of the first and second series of belts 84, 114, and 116. A controller 266 compares the speed signals and effects operation of a belt drive 302 or 304 to vary the speed of movement of at least one belt 114 or 116 in one of the series of belts in response to a change in relationship between the speed signals.

In one specific embodiment of the sheet material handling apparatus, the first series 84 of belts includes a plurality of tapes 130, 132, 138, 144, 146, 150, 156, 158, 162, 170, 172 and 176 which engages sheet material 30 on opposite sides of a fold line. In this apparatus, the second series of belts includes a pair of creaser belts 114 and 116 which are aligned with a fold line and engage the sheet material 30 along opposite sides of the fold line. The speed of movement of the tapes 84 and creaser belts 114 and 116 is compared. The speed of movement of the creaser belts 114 and 116 is varied during operation of the apparatus to maintain the speeds of the creaser belts 114 and 116 equal to the speed of the tapes 84. When the sheet material has been deformed (FIGS. 9 and 10) before entering the apparatus, for example by a preceding folder 32, the creaser belts 114 and 116 can be driven at slightly different speeds to eliminate the deformation.

Having described specific preferred embodiments of the invention, the following is claimed:

1. A folder for forming a fold along a predetermined fold line in sheet material, said folder comprising first longitudinally extending deflector means disposed on a first side of the fold line and extending from an inlet portion of said folder to an outlet portion of said folder for deflecting sheet material extending from an area on the first side of the fold line in a first direction as the sheet material moves from the inlet portion of said folder to the outlet portion of said folder, second longitudinally extending deflector means disposed on a second side of the fold line and extending from the inlet portion of said folder to the outlet portion of said folder for deflecting sheet material extending from an area on the second side of the fold line in the first direction as the sheet material moves from the inlet portion to the outlet portion of said folder, said first and second deflector means including deflector surfaces for engaging areas of the sheet material which areas increase as the sheet material moves away from the inlet portion of said folder toward the outlet portion of said folder, a first series of belts at least partially disposed between said first and second deflector means for gripping and moving sheet material along said first and second deflector means in a direction away from the inlet portion of said folder toward the outlet portion of said folder, a second series of belts at least partially disposed between said first and second deflector means for gripping sheet material while the sheet material is being gripped and moved by the first series of belts, said second series of belts extending beyond said first series of belts toward the outlet portion of said folder to enable said second series of belts to grip and move the sheet material along said first and second deflector means away from said first series of belts and toward the outlet portion of said folder after the sheet material has been separated from said first series of belts, drive means for varying the speed of movement of at least one driven belt in one of said first and second series of belts, first signal generator means for providing a first speed signal which is a function of the speed of movement of at least one belt in said first series of belts, second signal generator means for providing a second speed signal which is a function of the speed of movement of at least one belt in said second series of belts, and control means for comparing the first and second speed signals and for effecting operation of said drive means to vary the speed of movement of at least said one driven belt in said one series of belts in response to a change in the relationship between said first and second speed signals.

2. A folder as set forth in claim 1 wherein said first series of belts includes a first plurality of tapes disposed on the first side of the fold line and a second plurality of tapes disposed on the second side of the fold line, said second series of belts including a pair of creaser belts which extend from between the first and second pluralities of tapes to the outlet portion of said folder and are aligned with the fold line to engage the sheet material along opposite sides of the fold line.

3. A folder as set forth in claim 2 wherein the distance between said first longitudinally extending deflector means and said second longitudinally extending deflector means is greater at the inlet portion of said folder than at the outlet portion of said folder, said first plurality of tapes including first upper and lower tapes which engage a flat area of the sheet material disposed on the first side of the fold line and second upper and lower tapes which engage the flat area of the sheet material on the first side of the fold line at a location between the fold line and the first upper and lower tapes, said second plurality of tapes including third upper and lower tapes which engage a flat area of the sheet material disposed on the second side of the fold line and fourth upper and lower tapes which engage the flat area of the sheet material on the second side of the fold line at a location between the fold line and the third upper and lower tapes.

4. A folder as set forth in claim 2 wherein said pair of creaser belts includes a first creaser belt having surface means defining a longitudinally extending groove portion disposed adjacent to a first side of the sheet material and a second creaser belt having surface means defining a longitudinally extending nose portion disposed adjacent to a second side of the sheet material, said longitudinally extending groove and nose portions of said first and second creaser belts cooperating to maintain a crease in the sheet material and to hold the sheet material against sidewise movement relative to a longitudinal central axis of said folder as the sheet material moves into the outlet portion of said folder.

5. A folder as set forth in claim 2 wherein at least some of the tapes of said first plurality of tapes remain in engagement with the sheet material from the inlet portion of said folder to a first location spaced a first distance from said outlet portion of said folder, said pair of creaser belts moving into engagement with the sheet material at a second location spaced a second distance from said outlet portion of said folder and remaining in engagement with the sheet material to the outlet portion of said folder, said second distance being greater than said first distance.

6. A folder as set forth in claim 1 wherein said first series of belts, includes an array of upper and lower tapes, said array of upper and lower tapes tapering from a first width at the inlet portion of said folder to a second width which is smaller than the first width and which is disposed at a narrow end portion of the array at a location between the inlet and outlet portions of said folder, said array of upper and lower tapes having surface means for gripping opposite sides of the sheet material and holding the sheet material flat on opposite sides of the fold line in areas which decrease in the distance which they extend transversely outwardly from the fold line as the sheet material moves through said folder, said deflector surfaces in said first and second deflector means engaging areas of the sheet material which increase as the flat area of the sheet material engaged by said array of upper and lower tapes decreases.

7. A folder as set forth in claim 6 wherein said second series of belts extends from the narrow end portion of said array of upper and lower tapes to the outlet portion of said folder, said second series of belts including surface means for pressing against opposite sides of the sheet material along the fold line after the sheet material has moved out of engagement with said array of upper and lower tapes and while the sheet material is deflected by said first and second deflector means.

8. A folder as set forth in claim 1 wherein said second series of belts includes first and second belts which engage opposite sides of the sheet material, said drive means including first belt drive means for varying the speed of movement of said first belt and second belt drive means for varying the speed of movement of said second belt, said second signal generator means being connected with said first belt to provide a second speed signal which is a function of the speed of movement of said first belt, said folder further including third signal generator means connected with said second belt to provide a third speed signal which is a function of the speed of movement of said second belt, said control means further including means for comparing said third speed signal with at least one of said first and second speed signals and for effecting operation of said second belt drive means to vary the speed of movement of said second belt in response to a change in the relationship between said third speed signal and said one of said first and second speed signals.

9. A folder as set forth in claim 8 wherein said control means includes means for effecting operation of one of said first and second belt drive means to maintain the speed of movement of one of said first and second belts at a speed which is greater than the speed of the other of said first and second belts.

10. A folder as set forth in claim 9 wherein said control means includes means for effecting operation of one of said first and second belt drive means to maintain the speed of movement of one of said first and second belts at a speed which is the same as the speed of movement of said first series of belts.

11. A folder as set forth in claim 1 wherein said control means includes means for effecting operation of said drive means to maintain the speed of movement of said first series of belts the same as the speed of movement of said second series of belts.

12. A sheet material handling apparatus comprising first folder means for forming a first fold in the sheet material, said first folder means including means which deflects the sheet material adjacent to the first fold to impart a deformed configuration to the sheet material, second folder means for receiving sheet material from said first folder means with the sheet material in a deformed configuration and for forming a second fold in the sheet material along a fold line which extends through the first fold, said second folder means including a first belt which engages a first side of the sheet material and a second belt which engages a second side of the sheet material to grip the sheet material while the sheet material is in the deformed configuration and to move the sheet material along a path extending transversely to the first fold line, and drive means for moving said first and second belts and for maintaining the speed of movement of said first belt at a speed which is greater than the speed of said second belt, said first belt including surface means for transmitting force from said first belt to one side of the sheet material to pull the one side of the sheet material forward and change the configuration of the sheet material from a deformed configuration as the sheet material is being moved by said first and second belts.

13. A sheet material handling apparatus as set forth in claim 12 wherein said second folder means includes a first longitudinally extending deflector means disposed on a first side of the fold line along which the second fold is formed and extending from an inlet portion of said second folder means to an outlet portion of said second folder means for deflecting sheet material extending from an area on the first side of the fold line in a first direction as the sheet material moves from the inlet portion of said first folder means to the outlet portion of said first folder means, and second longitudinally extending deflector means disposed on a second side of the fold line and extending from the inlet portion of said folder to the outlet portion of said folder for deflecting sheet material extending from an area on the second side of the fold line in the first direction as the sheet material moves from the inlet portion to the outlet portion of said second folder means, said first and second deflector means including deflector surfaces for engaging areas of the sheet material which increase as the sheet material moves away from the inlet portion of said second folder means toward the outlet portion of said second folder means.

14. A sheet material handling apparatus as set forth in claim 12 further including first signal generator means for providing a first speed signal which is a function of the speed of movement of said first belt and second signal generator means for providing a second speed signal which is a function of the speed of movement of said second belt, and control means connected with said drive means and said first and second signal generator means for efffecting operation of said drive means to vary the speed of movement of at least one of said belts in response to a change in the relationship between said first and second speed signals.

15. An apparatus for use in handling sheet material, said apparatus comprising a first continuous belt having a side portion for engaging a side of the sheet material, a first plurality of pulleys engaging said first belt said first plurality of pulleys being rotatable during movement of said first belt, and cooperating with said first belt in a manner which results in variations in the effective pitch diameters of said first plurality of pulleys during movement of said first belt, a second continuous belt having a side portion for engaging a side of the sheet material at a location opposite from said first belt, a second plurality of pulleys engaging said second belt, said second plurality of pulleys being rotatable during movement of said second belt and cooperating with said second belt in a manner which results in variations in the effective pitch diameters of said second plurality of pulleys during movement of said second belt, said first and second belts cooperating to grip the sheet material and move the sheet material during movement of said first and second belts, said first and second belts cooperating to hold the sheet material during movement of the sheet material by said first and second belts, first drive means for driving said first belt, second drive means for driving said second belt, first signal generator means for providing a first speed signal which is a function of the speed of movement of said first belt, second signal generator means for providing a second speed signal which is a function of the speed of movement of said second belt, and control means connected with said first and second drive means and said first and second signal generator means for effecting operation of said first and second drive means as a function of the first and second speed signals to maintain the relationship of the speed of movement of said first belt to the speed of movement of said second belt substantially constant even though the effective pitch diameters of said first and second plurality of pulleys vary during movement of said first and second belts.

16. An apparatus as set forth in claim 15 further including a series of tapes for gripping and moving sheet material toward said first and second belts, said series of tapes including a first plurality of tapes disposed on a first side of a path of movement of said first and second belts and a second plurality of tapes disposed on a second side of the path of movement of said first and second belts, and third signal generator means for providing a third speed signal which is a function of the speed of movement of said series of tapes, said control means being connected with said third signal generator means and being effective to cause at least one of said drive means to vary the speed of movement of at least one of said belts as function of variations in the third speed signal.

17. An apparatus as set forth in claim 16 wherein said first and second belts engage opposite sides of the sheet material at a first location while the sheet material is being moved by said series of tapes, said series of tapes releasing the sheet material after the sheet material has been gripped by said first and second belts.

18. An apparatus as set forth in claim 15 wherein said control means includes means for effecting operation of one of said drive means to maintain the speed of movement of one of said belts at a speed which is greater than the speed of the other belt.

19. An apparatus as set forth in claim 15 wherein said control means includes means for effecting operation of said first and second drive means to maintain the speed of movement of said first and second belts at the same speed.

20. An apparatus as set forth in claim 15 further including first longitudinally extending deflector means disposed on a first side of said first and second belts for deflecting sheet material in a first direction as the sheet material is moved by said first and second belts, second longitudinally extending deflector means disposed on a second side of said first and second belts for deflecting sheet material in the first direction as the sheet material is moved by said first and second belts, at least a portion of said first and second belts being disposed between said first and second deflector means.

21. An apparatus as set forth in claim 15 wherein said side portion of said first belt includes surface means for defining a continuous longitudinally extending groove in said side portion of said first belt, said side portion of said second belt defining a continuous longitudinally extending nose portion which cooperates with the groove in said side portion of said first belt to maintain a crease in the sheet material and to hold the sheet material during movement of the sheet material by said first and second belts.

22. An apparatus for handling sheet material articles, said apparatus comprising a first belt for engaging a first side of a sheet material article, a second belt for engaging a second side of the sheet material article, drive means for moving the first and second belts to move the sheet material article, first signal generator means for providing a first signal which is a function of the speed of movement of the first belt, second signal generator means for providing a second signal which is a function of the speed of movement of the second belt, and control means connected with said first and second signal generator means and said drive means for effecting operation of said drive means to vary the speed of movement of at least one of said belts in response to a change in the relationship between said first and second signals.

23. An apparatus set forth in claim 22 wherein said drive means is operable to maintain the speed of movement of said first belt the same as the speed of movement of said second belt.

24. An apparatus as set forth in claim 22 wherein said drive means is operable to maintain the speed of movement of said first belt at a speed which is greater than the speed of movement of said second belt.

25. An apparatus as set forth in claim 22 wherein said first belt is a first creaser belt having a longitudinally extending groove portion disposed adjacent to the first side of the sheet material and said second belt is a second creaser belt having a nose portion which cooperates with said groove portion of said first creaser belt to maintain a crease in the sheet material article.

26. An apparatus as set forth in claim 25 further including a plurality of tapes which grip the sheet material article and move the sheet material article to said first and second creaser belts, said first and second creaser belts engaging the sheet material article while the sheet material article is moved by said plurality of tapes.

27. An apparatus as set forth in claim 26 further including third signal generator means for providing a third signal which is a function of the speed of movement of the sheet material article by said plurality of tapes, said control means including means for effecting operation of said drive means to vary the speed of movement of said first and second creaser belts as a function of changes in the speed of movement of the sheet material article by said plurality of tapes.

* * * * *